United States Patent [19]

Lester

[11] 4,099,357

[45] Jul. 11, 1978

[54] BUILDING PANELS, AND A BUILDING AND METHOD UTILIZING BUILDING PANELS

[76] Inventor: Allan Gerald Lester, 32 Curzon Ct., Klein St., Hillbrow, Johannesburg, Transvaal Province, South Africa

[21] Appl. No.: 677,984

[22] Filed: Apr. 19, 1976

[30] Foreign Application Priority Data

May 1, 1975 [ZA] South Africa ..... 75/2818

[51] Int. Cl.[2] ..... E04D 1/00

[52] U.S. Cl. ..... 52/533; 52/537; 52/549; 52/747

[58] Field of Search ..... 52/533, 537, 549, 520, 52/521, 527, 538, 542, 547, 543, 747

[56] References Cited

U.S. PATENT DOCUMENTS

| | | | |
|---|---|---|---|
| 1,179,523 | 4/1916 | Hammond | 52/521 |
| 1,376,751 | 5/1921 | Edwards | 52/533 X |
| 2,112,178 | 3/1938 | Selph | 52/537 X |
| 2,124,830 | 7/1938 | Roth | 52/748 |
| 3,852,933 | 12/1974 | Guzzo | 52/533 |
| 3,898,783 | 8/1975 | Matlock et al. | 52/520 X |
| 3,990,206 | 11/1976 | Reusser | 52/521 X |

*Primary Examiner*—Ernest R. Purser
*Assistant Examiner*—Carl D. Friedman

[57] ABSTRACT

A building panel has first and second opposed marginal ridges. The first of the marginal ridges is provided with an attachment zone whereby the panel is attachable to a building structure by at least one fastener. The second marginal ridge is of different cross-section but partly complementary to the first marginal ridge and can be laid in overlapping relationship over a first marginal ridge of an identical panel already attached to a building structure. The second marginal ridge then covers and conceals the attachment of the identical panel to the building structure.

9 Claims, 5 Drawing Figures

BUILDING PANELS, AND A BUILDING AND METHOD UTILIZING BUILDING PANELS

This invention relates to a building panel, to a building and to a covering for a building.

According to the invention there is provided a building covering comprising at least two building panels, each having first and second opposed marginal ridges, the first marginal ridge of each panel being provided with an attachment zone whereby the panel is attachable to a building structure by at least one fastener, and the second marginal ridge of each panel being of different cross-section but partly complementary to the first marginal ridge thereof, the second marginal ridge of one said panel being laid in overlapping relationship over a first marginal ridge of another said panel to cover the attachment zone of said other panel.

The overlapping marginal ridges may define a cavity adjacent to said attachment zone and intermediate the second marginal ridge of said one panel and the first marginal ridge of said other panel, whereby said cavity can receive a head of a fastener attaching the attachment zone to a building structure.

The attachment zone may be a flange extending from an outermost flank of the first marginal ridge. An innermost flank of the second marginal ridge may preferably be inclined with respect to the outermost flank of the first marginal ridge to define, in use, a substantially triangular cavity between itself and the flange and outermost flank of the first marginal ridge which it overlaps.

The panel may include a plurality of substantially parallel ridges, and the ridges may be separated by substantially co-planar bands. Each ridge may have a pair of flanks converging towards a central strip connecting the flanks, the strips being in a plane substantially parallel to the bands separating the ridges. The outermost flank of the first marginal ridge may be perpendicular to the plane of the bands.

The invention also provides a building including a structure and a covering fixed to the structure, the covering comprising a plurality of panels each with first and second marginal ridges at opposite edges thereof, wherein the first marginal ridge of each panel has an attachment zone attached to the structure by fasteners, wherein the second marginal ridges of all but an endmost panel overlap, receive, and are fixed to respective first marginal ridges, and wherein the fasteners attaching the overlapped first marginal ridges to the structure are covered and concealed by the overlapping second marginal ridges.

The fasteners may, for example, be screws or bolts and may be attached to purlins of the building structure. The attachment zones may be flanges which lie against the purlins. The first and second marginal ridges may be fixed together by rivets or any other suitable fasteners.

The covering may advantageously be a roof of a building and the constructions of the covering can then prevent rain from having direct access to the connectors and can therefore reduce the likelihood of water leaking through the covering.

The invention further provides a building panel having first and second opposed marginal ridges and a plurality of further ridges parallel to the first and second ridges, each of said further ridges and of said marginal ridges having a pair of flanks converging towards a central strip connecting the flanks; said first marginal ridge being provided with an outermost flank furthest from the second marginal ridge, an innermost flank closest to the second marginal ridge, and attachment means extending from the outermost flank whereby the panel is attachable to a building structure by at least one fastener; and the second marginal ridge being of different cross-section but partly complementary to the first marginal ridge for laying in overlapping relationship over a first marginal ridge of an identical panel, wherein the innermost flank of the second marginal ridge is inclined with respect to the outermost flank of the first marginal ridge for defining a substantially triangular cavity between itself and an outermost flank of a first marginal ridge which it overlaps.

An embodiment of the invention will now be described by way of example, with reference to the accompanying drawings, in which.

Figure 1:
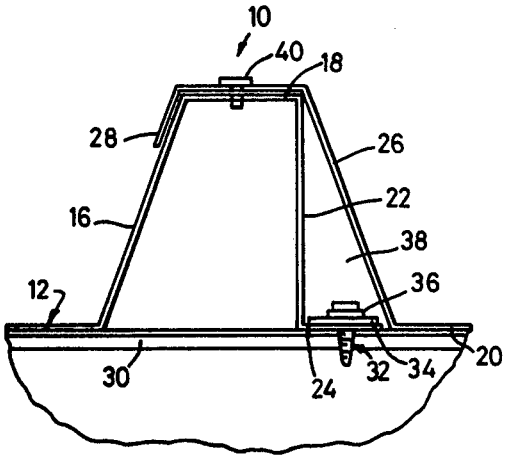
FIG. 1 is a partial cross-section through a part of a building.
Figure 3:
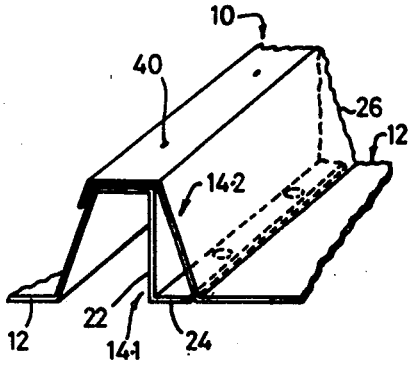
FIG. 3 is a three-dimensional view of part of the covering of the building.
Figure 2:
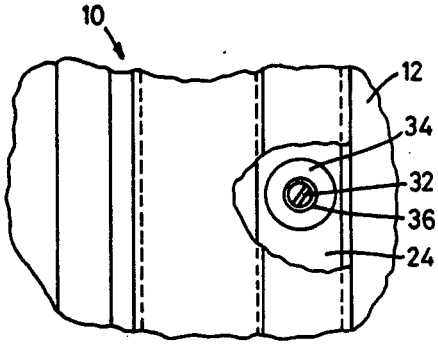
FIG. 2 is a partially cut away plan view of the part of the building shown in FIG. 1.

The covering illustrated generally at 10 comprises a plurality of building panels 12. Each of the panels has a plurality of substantially parallel, elongate ridges 14 including marginal ridges 14.1 and 14.2 at opposite edges thereof. Each of the ridges has flanks 16 which converge towards one another and which are connected together at their closest edges by connecting strips 18. The ridges are connected to one another by parallel bands 20. The bands 20 are substantially co-planar and the strips 18 are located in planes substantially parallel to the plane of the bands.

Each of the marginal ridges 14.1 has an outermost flank 22, that is outermost with respect to the panel of which it forms part, and this flank is at right angles to the plane of the bands 20. A flange 24 extends along the edge of the flank 22 that is spaced from the adjacent connecting strip 18.

The marginal flange 14.2 at the opposite end of each panel has an inclined innermost flank 26 at its side nearest to the other marginal ridge 14.1 of the panel, and has a shortened flank 28 forming the outer edge of the panel.

To mount the covering on a building structure, for example as a roof, a single panel is mounted on the structure with the bands 20 and flange 24 lying on the structure. Holes are made in the flange and are aligned with holes made in purlins 30 of the structure. Fastener 32 such as a selftapping screw is screwed through the flange into the purlin, a flat washer 34 and a spring washer 36 being located between the flange and the head of the fastener 32. Instead of using screws, a hole may be provided in the flange 24 next to the purlin 30 and the flange may be attached to the purlin by a hook bolt hooking over the purlin. Rivets may also be used as connectors.

A second panel is then laid on the structure next to the first panel with the marginal ridge 14.2 thereof overlapping and receiving part of the marginal portion 14.1 of the panel already attached to the structure. Because of the different shapes of the marginal ridges, a cavity 38 is formed between the outermost flank 22 of the ridge 14.1 and the inner flank 26 of the ridge 14.2. The head of the fastener 32 is received in this cavity. The adjacent band 20 of the second panel lies flat against the purlin 30 next to the flange 24 as shown in FIG. 1. The overlapping strips 18 of the two panels are fixed together by rivets 40 or sheet bolts and washers and the overlapping engagement of the two ridges ensures that rain cannot pass between the two panels.

Further panels are mounted on the building structure by connecting their flanges 24 to the structure and then connecting the marginal ridges 14.1 and 14.2 of adjacent panels together in the manner described and illustrated.

Figure 4:
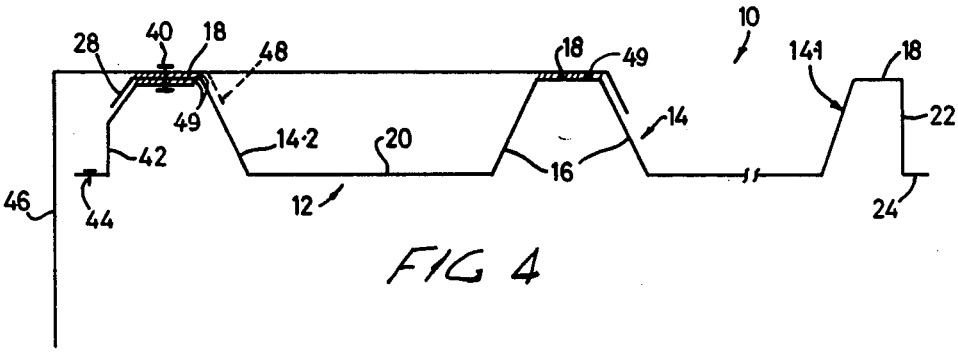
FIG. 4 shows an edge portion of the covering including a gable trim.

At one edge of the covering, there will be a flange 24 that is not covered by an adjacent panel and at the other end of the covering there will be a marginal ridge 14.2 that is not connected to the structure by an adjacent marginal ridge 14.1. The free marginal ridge 14.2 is therefore connected to the structure by a connecting element 42 having the cross-section shown in FIG. 4, the connecting element being fixed to the building structure (not shown) by a connector or fastener 44.

A gable trim 46 overlaps the two ridges adjacent to the outside edge of the covering and is fixed to the adjacent marginal ridge by rivets 40. It is also connected to the connecting element 42 associated with the ridge 14.2 by these rivets. If desired the gable trim 46 may overlap only a single ridge of the panel in which case it is shortened and terminates at the location indicated in chain lines at 48.

A sealant 49 (FIG. 4) is provided between the connecting strips 18 of adjacent panels and between the strips 18 and gable trim 46 to make the covering completely water tight.

Because the flanges 24 to be attached to the building structure are at the edge of each panel, workmen attaching the panel may easily see where they make the holes for fasteners. Furthermore, because the heads of the fasteners 32 are completely enclosed, there is no need to use sealing washers. Furthermore, ready access to the fasteners 32 is prevented. This makes it considerably more difficult for thieves to remove the covering to obtain access to the building.

The panels 12 are each made as a unitary panel and may be made of mild steel, stainless steel, copper, aluminium, asbestos, fibreglass or other suitable material.

Figure 5:
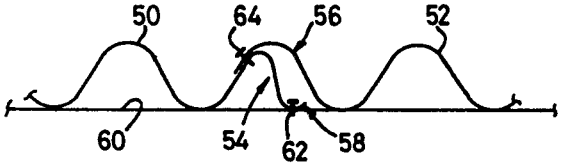
FIG. 5 shows part of another building.

In FIG. 5, two alternative, generally sinusoidal panels 50 and 52 are shown having first and second marginal ridges 54 and 56 in overlapping relationship. The marginal ridges have different cross-sections, an attachment zone 58 of the ridge 50 being attached to a building structure 60 by a fastener 62. The second marginal ridge 56 overlaps the first ridge 54 and is attached to it by another fastener 64. The second ridge 56 conceals and covers the fastener 62 attaching the first marginal ridge 54 to the building structure 60.

I claim:

1. A panel assembly comprising at least two panels arranged in contiguous relationship, each of said panels having first and second opposed marginal ridges, the first marginal ridge being provided with an attachment zone whereby the panel is attached to a structure by at least one fastening means, and the second marginal ridge being of different cross-section but partly complementary to the first marginal ridge thereof and being adapted to be placed in overlapping relationship over the first marginal ridge of a contiguous panel to cover the attachment zone thereof, said contiguous panels forming a cavity between the respective second marginal ridges and the attachment zones and covering said fastening means, each of said overlapping first and second opposed marginal ridges having a pair of spaced flanks connected together by a substantially planar central strip, the first marginal ridge having innermost and outermost flanks diverging away from one another as they extend from the central strip, the central strips of contiguous panels overlapping each other adjacent one another and are fixed together by fastening means spaced from said structure, said fastening fixedly clamping said central strips together to secure said panels against relative movement.

2. An assembly according to claim 1, wherein the overlapping central strips are of approximately the same width whereby the central strip of one of said contiguous marginal ridges is located precisely against the central strip of the other of said contiguous marginal ridges.

3. An assembly according to claim 1, wherein the first marginal ridge of each panel has its outermost flank substantially perpendicular to the central strip, and wherein the attachment zone comprises flange means extending from said perpendicular flank and spaced from the flanks of the second ridge of the contiguous panel.

4. An assembly according to claim 1, wherein the fastening means spaced from the structure comprises rivets passing through holes in the central strips and fixing the central strips rigidly together.

5. A panel assembly including first and second panels each having first and second opposed ridged marginal portions, the first marginal portion of the first panel including an attachment zone lying substantially flat against a structure and attached to the structure by at least one fastening means, the second marginal portion of the second panel being partly complementary to the first marginal portion of the first panel and being laid in overlapping relationship over the first marginal portion of the first panel and fixed rigidly thereto with the second panel at least partly covering the attachment zone of the first panel, fastening means spaced from said structure and passing through each of the overlapping marginal portions, and exerting a clamping force on each marginal portion thereby fixing said overlapping marginal portions together, each panel having at least one further ridge parallel to the marginal ridges and further having substantially co-planar bands provided between ridges thereof, and each of the marginal ridges having innermost and outermost converging flanks, the outermost flank of the first marginal ridge of each panel being substantially perpendicular to the co-planar bands and the attachment zone attached to the structure comprising flange means extending from and substantially perpendicular to the outermost flank, the attachment zone of the first panel, the outermost flank of the first marginal ridge of the first panel, and the second marginal ridge of the second panel forming a substantially triangular cross-section cavity.

6. A panel assembly including first and second panels each having first and second opposed ridged marginal portions, the first marginal portion of the first panel including an attachment zone lying substantially flat against a structure and attached to the structure by at least one fastening means, the second marginal portion of the second panel being partly complementary to the first marginal portion of the first panel and being laid in overlapping relationship over the first marginal portion of the first panel and fixed rigidly thereto with the second panel at least partly covering the attachment zone of the first panel, means spaced from said structure and fixing said overlapping marginal portions together, each panel having at least one further ridge parallel to the marginal ridges and further having substantially co-planar bands provided between ridges thereof, and each of the marginal ridges having innermost and outermost converging flanks, the outermost flank of the first marginal ridge of each panel being substantially perpendicular to the co-planar bands and the attachment zone attached to the structure comprising flange means extending from and substantially perpendicular to the outermost flank, a substantially triangular cross-section cavity being formed between the attachment zone of the first panel, the outermost flank of the first marginal ridge of the first panel, and the second marginal ridge of the second panel.

7. The assembly of claims 6, wherein the means fixing said overlapping marginal portions together comprises rivets.

8. A panel assembly on a structure, the assembly including first and second panels each having first and second opposed ridged marginal portions and a substantially planar band adjacent to said first marginal portion, the first marginal portion of the first panel including a ridge and an attachment zone at the opposite side of the ridge to the band, the attachment zone lying substantially against the structure and being attached to the structure by at least one fastening means, the second marginal portion of the second panel being partly complementary to the first marginal portion of the first panel, the second marginal portion of the second panel being laid in overlapping relationship over the first marginal portion of the first panel and defining a cavity receiving a part of the fastening means with the second panel at least partly covering the attachment zone of said first panel, the second marginal portion of the second panel being attached to the first marginal portion of the first panel at a connection zone spaced from the attachment zone and the band by fastening means spaced from said structure, said fastening means comprising means passing through holes in the overlapping ridges and having a head at each end fixing the ridges together by clamping action.

9. An assembly according to claim 8, wherein the first and second marginal ridges are fixed together by rivets.

* * * * *